US005292133A

United States Patent [19]

Alexander

[11] Patent Number: 5,292,133

[45] Date of Patent: Mar. 8, 1994

[54] GEOGRAPHIC CULTURAL AND ECONOMIC BOARD GAME

[76] Inventor: Eugene D. Alexander, 6323 Georgia Ave. NW., Brighton Station, Washington, D.C. 20011

[21] Appl. No.: 842,521

[22] Filed: Feb. 27, 1992

[51] Int. Cl.[5] ..... A63F 3/00

[52] U.S. Cl. ..... 273/256

[58] Field of Search ..... 273/242, 243, 239, 251, 273/252, 254, 256

[56] References Cited

U.S. PATENT DOCUMENTS

| | | | |
|---|---|---|---|
| 1,534,591 | 4/1925 | Hodges | 273/251 X |
| 2,026,082 | 12/1935 | Darrow | 273/256 |
| 4,052,072 | 10/1977 | Beal | 273/254 |
| 4,283,059 | 8/1981 | Beeder | 273/254 |
| 4,988,108 | 1/1991 | Shepard | 273/254 |
| 5,009,429 | 4/1991 | Auxier | 273/256 X |

FOREIGN PATENT DOCUMENTS

| | | | |
|---|---|---|---|
| 2211750 | 7/1989 | United Kingdom | 275/254 |
| 8102526 | 9/1981 | World Int. Prop. O. | 273/239 |
| 8401518 | 4/1984 | World Int. Prop. O. | 273/254 |

*Primary Examiner*—William Stoll

*Attorney, Agent, or Firm*—Antonelli, Terry, Stout & Kraus

[57] ABSTRACT

A game construction wherein a gameboard is provided with an endless circular path surrounding a continent. The path includes designated nation spaces serially there-along, within nation blocks which correspond to incidental spaces within continental quadrants. Movement of tokens along the path is indicated by chance. The players attempt to acquire a majority of regional nations for the purpose of collecting revenue and are subject by chance to various import and export opportunities, thereby simulating personal and business life occurences and economic realities in actual particularly African nations. The winner is the wealthiest player at the end of the game.

10 Claims, 5 Drawing Sheets

FIG. 1
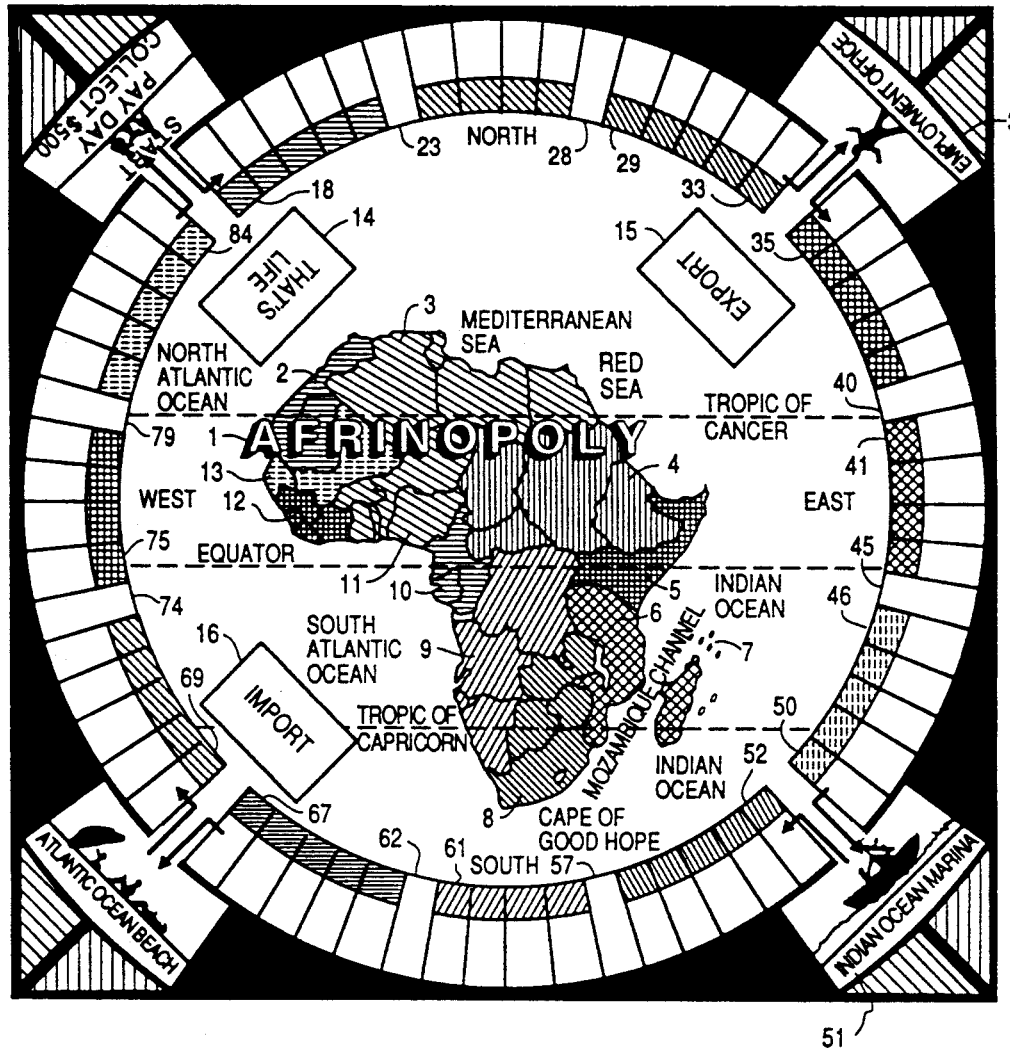
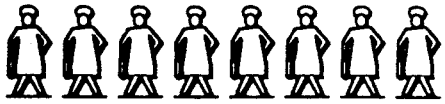
FIG. 2
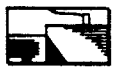
FIG. 3
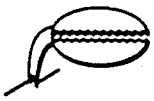
FIG. 4
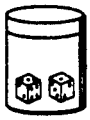
FIG. 5

GEOGRAPHIC CULTURAL AND ECONOMIC BOARD GAME

BACKGROUND OF THE INVENTION

There has been proposed in the prior art, a variety of games simulating barter, trading, and bargaining. Previous prior games, however, have provided only limited learning opportunities to its players due to the use of insignificant places and game components, therefore lacking any measurable amount of reality.

SUMMARY OF THE INVENTION

This invention provides a game board apparatus and concept which overcome prior art shortcomings by providing a highly realistic simulation of international trading via import and export activity. It also imparts a working knowledge of the geography and culture of different nations within a continent, as well as the regular occurences of daily life situations and corporate economics. Along with a players' self-determination and the element of chance, it also provides for a stimulating quest for attaining wealth.

The invention therefore comprises features of construction, combinations of elements, and arrangement of component parts which will be fully illustrated in the accompanying drawings, and of which the scope will be indicated by the appended claims.

DESCRIPTION OF THE DRAWINGS

FIG. 1 Is a plan view of the upper arrangement of the game board, illustrating the various component locations. Notation for spaces and color designations are indicated therein.

FIG. 2 Is an elevation view of the tokens that are used in the instant invention by the various players which are indicative of native African businessmen dressed in kente cloth outerwear with kofis (hats) and brief cases. Each token is robed distinctively.

FIG. 3 Is an isometric view of a factory which may be purchased by the player after acquiring a block of nations which is used to develop the nation and enhance revenue.

FIG. 4 Is a plan view of a Cowery Shell necklace which is bestowed to the wealthiest player at the conclusion of the game.

FIG. 5 Is an isometric view of the dice cup used to determine the length of a players move along the course.

DESCRIPTION OF THE PREFERRED EMBODIMENT

Referring to FIG. 1, a game construction of the present invention is illustrated as containing a game board requiring a suitable horizontal support. The game board includes an upper board attached to a lower board. The upper board includes removable puzzle pieces each formed in the shape of regional segments of the continent of Africa. When the puzzle pieces are removed a map area of the lower board can be viewed through the upper board. The map area serves as a template to the puzzle pieces. The playing surface is marked by an endless path, which is of circular configuration with interposed rectangular satellite spaces. There are, in the represented embodiment of the invention sixty-eight space locations on the board. Upon the shake of the dice, the players move their respective tokens as long as the play continues. Their is no winning or termination point within the continuous path of the playing surface. This process will be discussed in greater detail hereinafter.

Insofar as the game is known on the market as "AFRINOPOLY" that name is indicated on the board in the central area and marked 1, appropriately.

Figure 6:
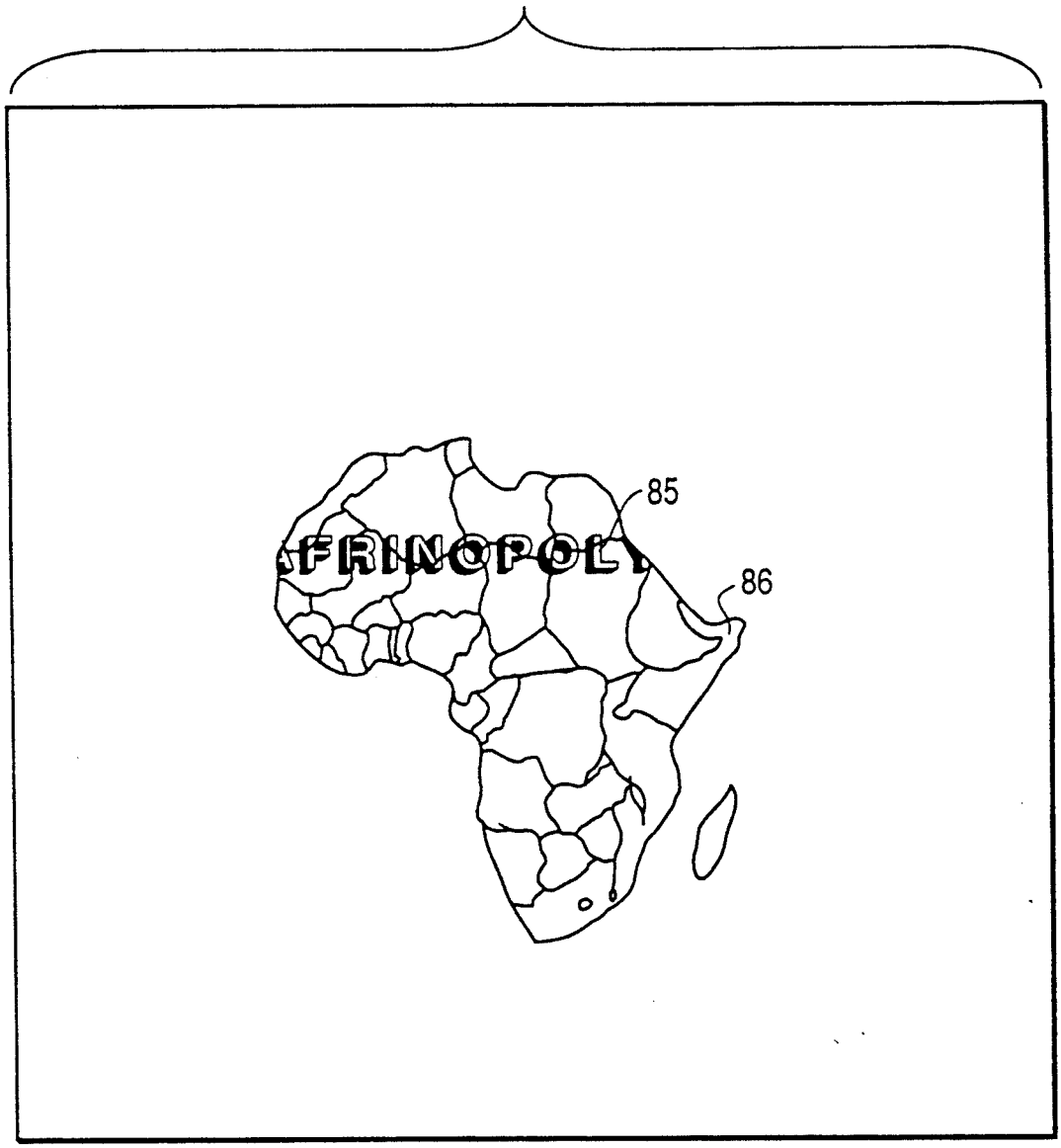
FIG. 6 Is a plan view of the lower board which is laminated to the upper board to form a one piece construction. It acts as a base and template for the various puzzles pieces which are part of the upper board. This component has a complete map of Africa indicating its various nations in upper case black lettering, and their respective capitol, cities in lower case red lettering.

Spaces 2–13 are regionally grouped nation areas which are also color coded removable inset puzzle pieces which are numbered clockwise, and whose locations are directly related to those spaces on the outer playing path. In this respect, this game substantially varies from other games where the use of map and color coded removable puzzle pieces was not related to an outside playing path. The removable puzzle pieces rest on the exposed map area of the lower board illustrated in FIG. 6. The lower board can be viewed through the upper board when the puzzle pieces are removed. Therefore, reading clockwise, puzzle piece 2 is colored blue and contains the nations Western Sahara, Mauritania, Cape Verde Islands, Morocco, and Algeria. Puzzle piece 3 is colored light green and contains the nations of Niger, Tunisia (25), Libya, and Egypt (27). The next puzzle piece 4 is colored red and contains the nations of Chad, Sudan, Uganda, Central African Republic, and Ethopia. Following, is puzzle piece 5 which is colored gold and contains the nations of Djibouti (35), Somalia, Kenya, Rwanda, and Burundi, Puzzle piece 6 constitutes the next area, and is colored orange and represents the nations of Tanzania, Mozambique, Madigascar, and Malawi. The following is puzzle piece 7 and is colored purple. It contains the nations of Comoros, Mayotte, Seychelles, Maritius and Reunion. Puzzle piece 8 is colored dark green and contains the nations of Zimbabwe, Lesotho, Zambia, Swaziland (55) and South Africa. The next puzzle piece 9, is colored brown and contains the nations of Namibia, Botswana, Angola, and Zaire.

Puzzle piece 10 contains the nations of Congo, Cameroon, Gabon, Equatorial Guinea, Sao Tome and Principe, and is colored light blue. The next puzzle piece 11 is green and contains the nations of Nigeria, Benin, Togo, Burkina, and Ghana. Following, is puzzle piece 12 is yellow and contains the nations of Sierra Leone, Ivory Coast, Liberia, Guinea. Finally, is puzzle piece 13 which is colored gray and contains the nations of Mali, Senegal, Gambia, and Guinea Bissau.

Areas 14, 15, and 16 are indicated at diagonal locations on the board and contain locations whereupon, the That's Life, Import and Export cards respectively are stored face down while the game is in progress. Any player who is required to draw from any of these decks of cards, follows the directions provided on the reverse of the card, and then replaces it face down on the bottom of the appropriate deck.

The four satellite spaces 17, 34, 51, and 68 are distinct spaces. The starting space 17, is marked "Start" and is also marked "Pay-Day", "Collect $500". Upon reaching this space with each successive trip around the board, each player is paid $500 by the banker. The following satellite space 34 is marked "Employment Office" which is explained in detail in the following text.

The next satellite space 51, is marked "Indian Ocean Marina", which is merely a rest area for which no fee can be charged or collected when a player lands on this space. The final satellite space 68, is marked "Atlantic Ocean Beach", which again, is a rest area for which no fee can charged or collected when a players lands on this space.

Fifty-five are provided on the playing path nation spaces contains, each of which contain the name of a country on the African continent as indicated in the previous text. All these areas of nations are indicated by distinctive colors in groups of adjacent nations, and share the identical color designation as that indicated in the puzzle piece inset. Therefore a unit of nations (4 or 5) represent a color block as well as the associated puzzle piece, which is obvious in the instant game. All nation blocks have color coordinated inner spaces which are utilitzed for the placement of factories, indication of adjaciencies, and distinction of location within the continent. The board is subdivided into four quadrants which are separated at its corners by the satellite spaces as indicated on FIG. 1. Beginning at the northern quadrant, are three blocks subdivided into spaces 18–22, 24–27, and 29–33 and color assignments are blue, light green, and red respectively, and indicated on FIG. 1, and in the previous text. Secondly, is the eastern quadrant, and contains three blocks subdivided into spaces 35–39, 41–44, 46–50 and the color designation is gold, orange, and purple respectively. The third, or southern quadrant, contains three blocks subdivided into spaces 52–56, 58–61, 63–67, and is designated dark green, brown, and light blue, respectively. The final or western quadrant contains three blocks, subdivided into spaces 70–73, 74–78, and 80–83 and is designated green, yellow, and gray, respectively.

Also dispersed within the playing path of the fifty-five nation spaces are various other miscellaneous spaces, which are in the instant invention the, "That's Life", "Import", "Export" and "Unemployed" spaces respectively, and located as indicated in FIG. 1. There are two "Import" spaces located at spaces 23 and 57. There are four "That's Life" spaces located at spaces 28, 45, 62, and 79. There are two "Export" spaces located at spaces 40 and 74. The final space on the playing path, 84, is the "Unemployed" space. When a player lands on this space he goes directly to the "Employment Office" (34) and remains for three turns.

There is no fixed limit for the number of players, however, only eight tokens are supplied with the game. One of the players should be appointed as Banker/Auctioneer, the person who is assigned to handle all monies and business transactions on behalf of the bank. This person may or may not engage in the play. All tokens represent African businessman robed in distinctive Kente cloth outerwear, kofis (hats), and brief cases. In this respect, the game differs from previous games where tokens were only miscellaneous objects, and had no substantial cultural significance.

Figure 7:
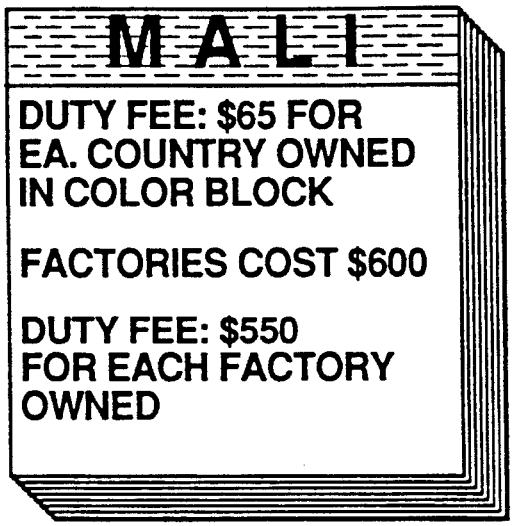
FIG. 7 Represents an example of the face of fifty-five such cards, which constitute the nation title cards for each of the nation spaces indicated on the board. Illustrated on the upper block of the card, is the nations name and the appropriate color designation. In the lower block, is the appropriate duty-fee, duty-fee instructions for multiple nation ownership, factory cost, and duty-fee costs with factory ownership. In ascending clockwise order duty-fees range $10 (Western Sahara, the first nation block after start) to $68 (Guinea Bissau, the last nation block on the board). Factories range in cost from $50 for the first block of nations, and increase at intervals of $50 per block in ascending clockwise order for 12 blocks. Factory cost in the last block of nations is $600.
Figure 8:
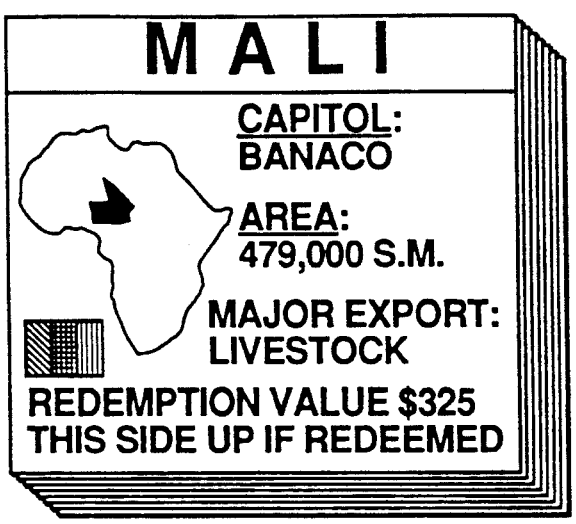
FIG. 8 Represents an example of the rear of fifty-five such cards which constitute the nation title cards for each of the nation spaces indicated on the board. Illustrated on the card, is the nations name in the upper block, the middle portion of the lower block contains a brief description of selected characteristics of the nation including the captiol city, the area, the nations major export, location within the continent, and its appropriate flag designation. The lower portion of the lower block indicates the redemption value ranging from $50 (Western Sahara, the first nation block after start) to $340 (Guinea Bissau the last nation on the board).
Figure 15:
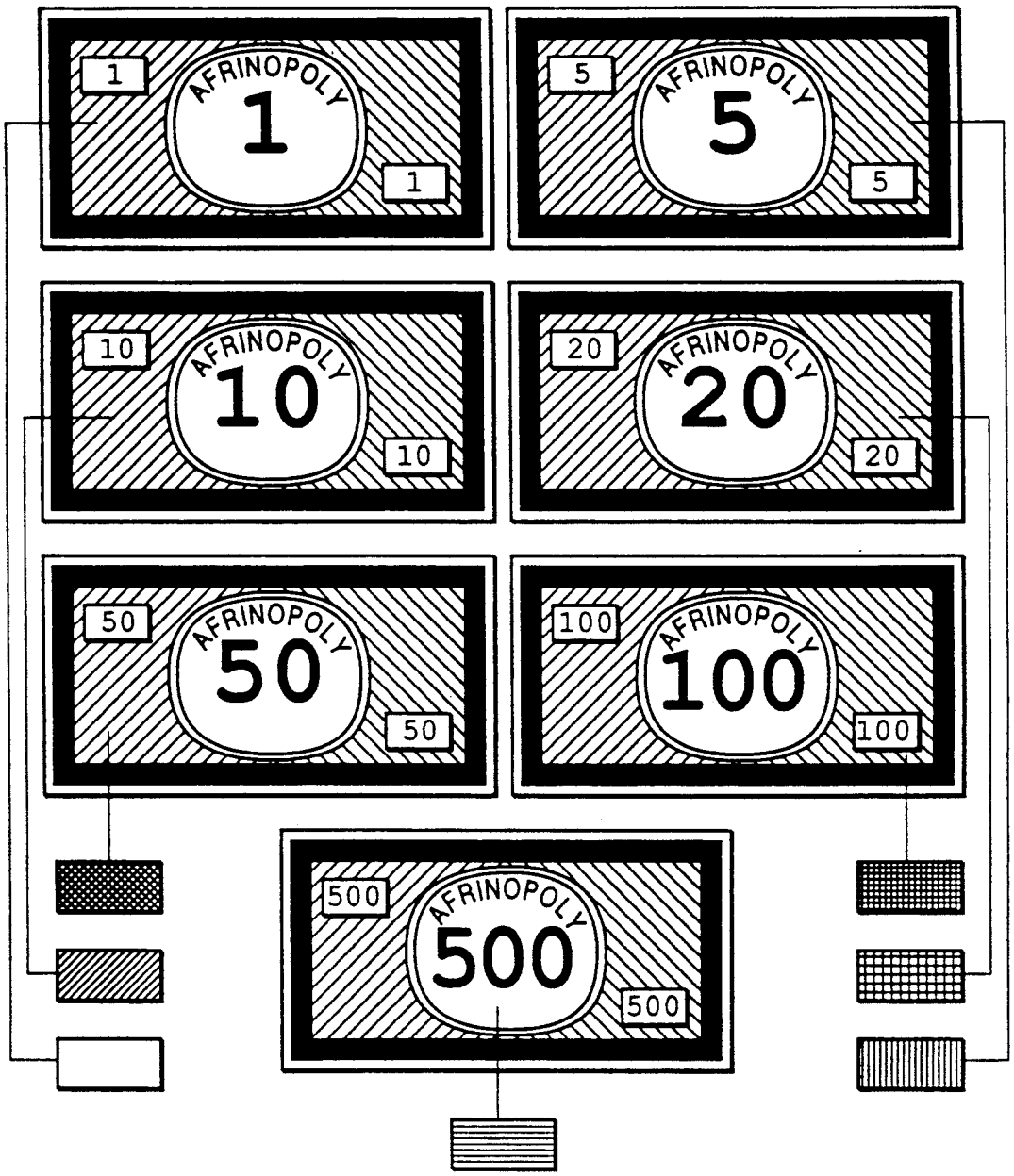
FIG. 15 Is a view of the play money used in denominations of $1, $5, $10, $20, $50, $100, and $500 bills.

All monies, are the responsibility of the banker, and are indicated in FIG. 15, and are provided in totalling denominations 3,000 to each player at the start of the game. The banker also retains all puzzle pieces until the entire color block of nations is owned, then he places each piece individually. The banker also holds the nation title cards representing each nation, which are distributed to the players once they purchase a country and are represented in FIG. 7 and FIG. 8.

The purchase price increases by ten dollar increments per space as a player travels the board. There are fifty-five nation cards in total, all of which have color coded blocks to match that of the corresponding nation space on the playing path, as previously indicated. Additionally, each card indicates the appropriate duty-fee to be charged to any player upon landing on a nation space already owned. The duty-fee increases as each player travels clockwise around the board.

Factories are used to develope countries and to increase its economic base, thus allowing for higher duty fees. The factory costs begin at fifty-dollars and increases by fifty-dollar increments for each block of nations as a player travels clockwise around the board. The factories are indicated in FIG. 3 and are black and white in color and one-hundred are supplied. The duty-fee with factory also starts at fifty-dollars and increases by fifty-dollar increments per block clockwise.

If a player owns multiple nations in a block, he is entitled to collect the amount indicated on the card, times the number of nations owned in that block. The factory owned duty-fee for that nation only is then added to the amount. It is therefore obvious that a player is entitled to increased revenues by owning multiple nations, or by further developing a nation by erecting factories thereon. Ultimately, a player strives to own all nations in a given color group or block of nations.

The redemption value is the amount of money a player receives if he surrenders ownership of a nation to the bank, and is equal to one-half the purchase price. The player must leave the card face down in front of him until he is able to remove the redemption status, which must be accomplished during his next turn.

If a player lands on a nation space and declines purchase, it may be auctioned by the bank beginning at the redemption value. The declining buyer cannot begin the bidding process, however, he may participate. The player who purchases the property receives the title card and must read the brief biography (which include, capitol, city, area, major export, location, and flag designation) aloud on the reverse of the card so as to educate all players about this nation's vital information. In this respect, this game differs from previous similar games which provided no real strong learning element and deals only with insignificant areas. In the instant game, a player learns vital information about each nation on the continent.

Figure 9:
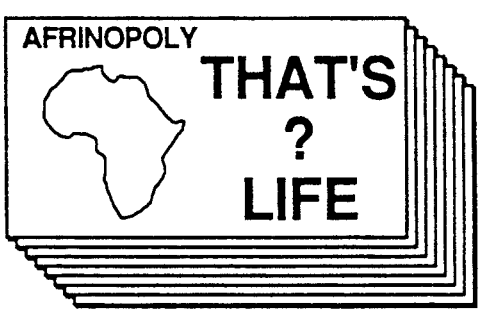
FIG. 9 Represents an example of the face of 24 cards which constitute the "That's Life" cards which are drawn individually when a player lands on a "That's Life" space indicated on the board.
Figure 11:
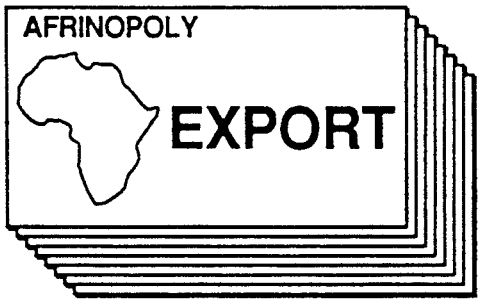
FIG. 11 Represents an example of the face of 28 cards which constitute the "Export" cards which are drawn individually when a player lands on an "Export" space indicated on the board. The directions thereon must be followed by the player who draws the card.
Figure 13:
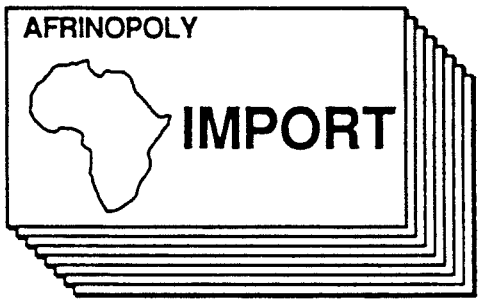
FIG. 13 Represents an example of the face of 28 card which constitute the "Import" cards which are drawn individually when a player lands on an "Import" space indicated on the board. The directions thereon must be followed by the player who draws the card.
Figure 10:
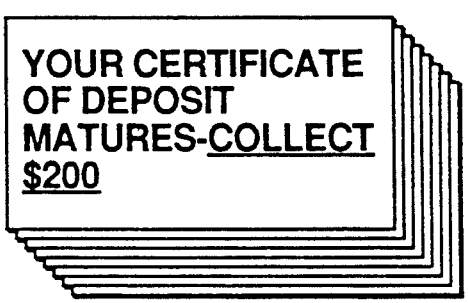
FIG. 10 Represents an example of the reverse side of 24 such "That's Life" cards which once drawn individually direct players to follow the instructions thereon.
Figure 12:
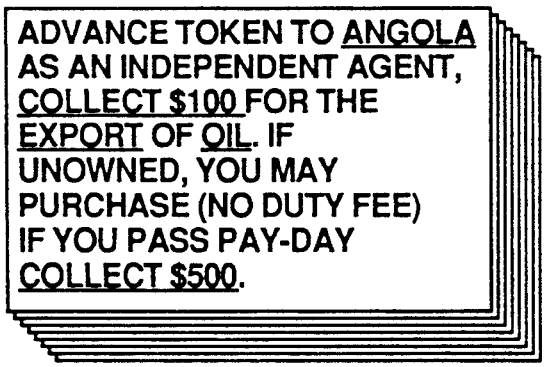
FIG. 12 Represents the reverse side of 28 such cards which constitutes the "Export" cards which provide instructions that the players must follow regarding export opportunities as they travel the continent.
Figure 14:
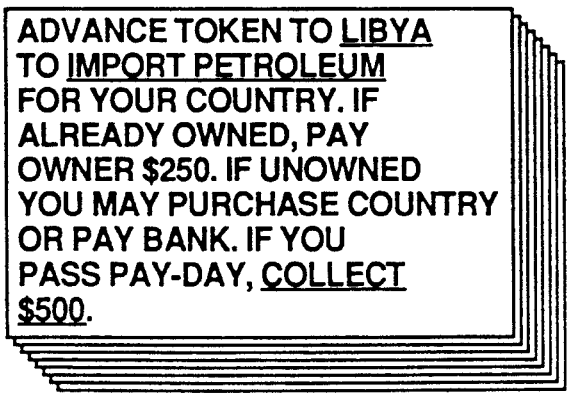
FIG. 14 Represents the reverse side of 28 such cards which constitutes the "Import" cards which provide instructions that the players must follow regarding Import opportunities as they travel the continent.

The plurality of "That Life" cards have been indicated in FIG. 9 and 10, and are indicative if real life experiences on a Day-To-Day basis. They provide personal financial benefits and penalties to the players as they are drawn. The plurality of "Import" and "Export" cards are indicated in FIG. 11, FIG. 12, FIG. 13, and FIG. 14. These cards provide the player with financial benefits or penalties with respect to the exports of each of the fifty-five nations. The owner of a nation that imports goods loses money, while the owner of a nation that exports makes money. Specific information is provided on each card for each nation with regard to its major export, tariff, or excise tax. Upon, drawing, a player too must read aloud, thus educating each player of the major export of a given nation. In this respect, this game differs from previous similar games which have not addressed the major industry within a given nation, the concept of the import/export business, or the provision of a learning element related thereto.

In a players quest for wealth, he should attempt to acquire as many nations in a given block, and the higher priced nations. He further increases his chance for windfall profits by erecting factories thereon. He must own the entire block before erecting factories and should erect according to his financial capability. He must build evenly for his nations. He must first put factories on each nation before erecting a second factory on any of his nations. If he is forced to redeem his factories, he must remove factories in the identical even manner.

If the player experiences financial hardship, he may sell his factories back to the bank for one-half the purchase price. If a player is forced to redeem his nation, he does so through the bank only. The redemption value is printed on the reverse of the title card related thereto, however factories are redeemed first. If and when he opts to repurchase, he must pay a ten percent surcharge to the bank. A player may sell his redeemed nation to any player at any price which both agree on.

According to the rules of the game, a state of bankruptcy occurs when a player is unable to pay his debt, and/or owes more than he is worth. If his debt is to another player he must turn over all his nations to the player he owes, and leave the game. He may not borrow or lend money to another player. So as to finalize the settlement process, he must turn over all his assets to the bank for the redeemed value, and then pay his creditors.

The game is started by each player shaking the dice cup. The highest total begins the play and continues clockwise. As a player lands on a given nation space he may purchase or decline, according to price printed on the game board. If already owned, he must pay the owner the duty-fee printed on the title card.

The owner must demand payment during that play, otherwise he forfeits his right to collect.

If a player owns multiple nations within a color group, he follows directions on the title card which allow for increased revenue, however, he must do the calculation himself. Duty-fees are paid directly to owner of said space. Nation sales transactions between players is allowable during a player's turn at any price under any conditions, however, factories are sold by the bank only. No duty-fee can be collected on redeemed property. If a player lands on spaces 23, 28, 40, 45, 57, 62, 74, 79. He must draw an "Import or Export" card which direct him to procede to a given nation space. He may purchase if it is unowned, however he must pay the duty-fee if owned unless otherwise directed by the instructions on the reverse of the card. He is also entitled to the benefits or penalties provided by the directions on the card.

If a player lands on any of the three satellite spaces, he incurs no penalty and receives no fee; these are merely rest areas. Every time a player reaches Pay-Day, he collects a $500 salary, which is paid by the bank. If, by chance, he lands on the "Unemployment" space (84), he must go directly to "Employment Office" (34) and remain for three consecutive turns. He also may be forced to go to the "Employment Office", if he shakes doubles three consecutive times, or if he is directed to do so by a "That's Life" card in which case, he does not collect his $500 salary indicated on space 17. However, if he draws any card that directs him to proceed to a given space he is entitled to collect his salary if he passes Pay-Day.

If a player lands in the "Employment Office" by the shake of the dice, no penalty is incurred, and he therefore moves ahead on his next turn. He may get out of "Employment Office" by paying $100, using an appropriate "That's Life" card, or shaking doubles before his third turn. If he is not sucessful, he must pay the $100 employment fee.

Concurrent with the distribution of nation cards, the banker is also charged with the placement of the appropiate puzzle piece on the board for those nations where the entire block is owned. By way of placement, all players know that factory erection is allowable and realizes adjaciencies of nations. In this respect, this game differs from previous games which did not indicate to other players if and when a block is available for enhanced improvement, nor made aware of the geographic location of nations relative to a regionally segmented path game board.

The play continues until one or more players is unable to meet his financial obligation, thus forcing him into bankruptcy as previously explained the, (or wealthiest player in the case of the shorter game version) is the winner and receives the "Cowery Shell Necklace" FIG. 4. This varies from previous art wherein a player did not reveive a prize for winning the game.

According to the description provided herein, it has been indicated that the game board apparatus constitutes a continuous path of which certain color designated spaces constitute a block, and that there are numerous such blocks, each differing in geographical location and value and relating to inset removable puzzle a. It is further indicated that player collects additional fees for multiple ownership and enhanced development, thus making a greater chance for personal wealth or opponent bankruptcy. It is also indicated that three sets of cards are used to indicate chances for personal financial rewards or penalties.

It is obvious that the game board apparatus as indicated herein presents a business environment of Import, Export, and personal life, similar to real life situations. These conditions are relative to the exports of actual nations as they presently exist, economic, industrial, and cultural data as it is, and dynamic financial scenarios as they may occur, thereby simulating realistic complex and exciting financial situations. The game may require several hours to complete, but generally all resolutions are consummated in the final moments of the game in which case all indebted players must relinquish all ownership and leave the game. The length of the game may be tailored to suit the players.

Therefore, having described and illustrated the embodiment of the invention, for the purpose of clarity and understanding, it it implied that certain changes and modifications may be made within the spirit of the invention, the scope is set forth, in the following claims:

I claim:

1. An economic, geographic, and cultural awareness board game apparatus, comprising;

a board having a playing surface which is a color-keyed map of a continent, a continuous circular playing path divided into a plurality of adjacent nation spaces, within distringuishable color blocks, and within four directionally significant quadrants with interposed satellite corner blocks, utilizing the acquisition of nations, and the exporting of resources;

a plurality of nation cards, each indicating required duty-fee and providing a brief description of the characteristics of a nation;

a plurality of import and export cards, said cards each indicating monetary loss or gain due to an import or an export transaction; and culturally significant tokens for moving on said playing path;

wherein said plurality of nation cards, color-keyed to said nation spaces, utilize printed duty-fees to generate revenue, each nation card providing said brief description of the characteristics of the nation on the reverse side thereof, said brief description including capitol city, total area, major export, location within the continent, and national flag.

2. A game board apparatus according to claim 1 wherein said culturally significant token represention are each native african businessmen distinctly robed in kente cloth apparel, kofi, and briefcase.

3. A game board apparatus according to claim 2 further comprising:

a prize for the winner in the form of a culturally significant cowery shell necklace.

4. A game board apparatus according to claim 1 wherein said color blocks of nation spaces correspond to regional segments of said map of said continent.

5. A game board apparatus according to claim 1 wherein said continent is Africa.

6. A game board apparatus according to claim 1 wherein said plurality of import and export cards which are drawn by chance illustrate by way of instruction, the major exports of various nations.

7. A game board apparatus according to claim 1 further comprising a prize for the winner in the form of a culturally significant cowery shell necklace.

8. An economic, geographic, and cultural awareness board game apparatus, comprising:

a board having a playing surface which is a color-keyed map of a continent and a continuous circular playing path which surrounds said map, said continuous circular playing path being divided into a plurality of adjacent nation spaces, within distinguishable color blocks color keyed to said map, utilizing the acquisition of nation, and the exporting of resources;

a plurality of nation cards, each indicating required duty-fee and providing a brief description of the characteristics of a nation; and a plurality of import and export cards each indicating monetary loss or gain due to an import or an export transaction wherein said plurality of nation cards, color-keyed to said nation spaces utilize printed duty fees to generate revenue, each nation card providing said brief description of the characteristics of the nation on the reverse side thereof, said brief description including capitol city, total area, major export, location within the continent and national flag.

9. A game board apparatus according to claim 8 wherein said map of said continent is regionally segmented.

10. A game board apparatus according to claim 8 wherein said color blocks of nation spaces correspond to regional segments of said map of said continent.

* * * * *